US010442596B2

(12) United States Patent
Vietz et al.

(10) Patent No.: US 10,442,596 B2
(45) Date of Patent: Oct. 15, 2019

(54) PACKAGING FOR POLYSILICON AND METHOD FOR PACKAGING POLYSILICON

(71) Applicant: Wacker Chemie AG, Munich (DE)

(72) Inventors: Matthias Vietz, Mattighofen (AT); Martin Brixel, Kirchdorf (DE); Joachim Mattes, Burghausen (DE); Peter Wimmer, Mehring (DE)

(73) Assignee: WACKER CHEMIE AG, Munich (DE)

( * ) Notice: Subject to any disclaimer, the term of this patent is extended or adjusted under 35 U.S.C. 154(b) by 0 days.

(21) Appl. No.: 15/567,095

(22) PCT Filed: Apr. 15, 2016

(86) PCT No.: PCT/EP2016/058424
§ 371 (c)(1),
(2) Date: Oct. 17, 2017

(87) PCT Pub. No.: WO2016/169859
PCT Pub. Date: Oct. 27, 2016

(65) Prior Publication Data

US 2018/0099800 A1 Apr. 12, 2018

(30) Foreign Application Priority Data

Apr. 23, 2015 (DE) ..... 10 2015 207 466

(51) Int. Cl.

| | |
|---|---|
| ***B65D 77/06*** | (2006.01) |
| ***B65D 85/00*** | (2006.01) |
| ***B65B 7/10*** | (2006.01) |
| ***B65B 25/00*** | (2006.01) |
| *B65B 5/12* | (2006.01) |

(52) U.S. Cl.
CPC ..... *B65D 77/062* (2013.01); *B65B 7/10* (2013.01); *B65D 77/061* (2013.01); *B65D 85/70* (2013.01); *B65B 5/12* (2013.01); *B65B 25/00* (2013.01); *B65B 2220/14* (2013.01); *B65B 2220/18* (2013.01)

(58) Field of Classification Search
CPC .... B65D 77/062; B65D 77/061; B65D 85/70; B65B 7/10; B65B 25/00; B65B 2220/14; B65B 2220/16; B65B 2220/18
USPC ..... 206/524.1; 220/495.06, 495.08, 495.07, 220/495.09, 495.1, 495.11
See application file for complete search history.

(56) References Cited

U.S. PATENT DOCUMENTS

| | | | | |
|---|---|---|---|---|
| 2,435,743 A * | 2/1948 | Geimer | B65D 31/02 383/101 |
| 2,620,119 A * | 12/1952 | George | B65D 5/12 229/109 |
| 5,354,569 A | 10/1994 | Brown et al. | |
| 7,013,620 B2 | 3/2006 | Hoelzlwimmer | |

(Continued)

FOREIGN PATENT DOCUMENTS

| | | |
|---|---|---|
| CN | 203997201 U | 12/2014 |
| EP | 1645333 A1 | 4/2006 |
| WO | 15007490 A1 | 1/2015 |

*Primary Examiner* — Andrew D Perreault
(74) *Attorney, Agent, or Firm* — Brooks Kushman P.C.

(57) ABSTRACT

Reduction of contamination and the proportion of fines fractions in the packaging of rod form polysilicon is achieved by directly filling a plastic bag with polysilicon from a cleaning bowl by a rotating motion which causes polysilicon chunks to slide into the bag.

16 Claims, 2 Drawing Sheets

(56) References Cited

U.S. PATENT DOCUMENTS

| | | | | |
|---|---|---|---|---|
| 7,549,600 | B2 | 6/2009 | Hesse | |
| 8,025,208 | B2 * | 9/2011 | Wisecarver | B65D 5/10 222/105 |
| 2010/0154357 | A1 | 6/2010 | Wochner | |
| 2010/0301108 | A1 | 12/2010 | Patrickus | |
| 2013/0269295 | A1 | 10/2013 | Lichtenegger | |
| 2016/0167862 | A1 | 6/2016 | Lichtenegger | |

* cited by examiner

PACKAGING FOR POLYSILICON AND METHOD FOR PACKAGING POLYSILICON

CROSS REFERENCE TO RELATED APPLICATIONS

This application is the U.S. National Phase of PCT Appln. No. PCT/EP2016/058424 filed Apr. 15, 2016, which claims priority to German Application No. 10 2015 207 466.8 filed Apr. 23, 2015, the disclosures of which are incorporated in their entirety by reference herein.

BACKGROUND OF THE INVENTION

1. Field of the Invention

The invention relates to the packaging of polysilicon.

2. Description of the Related Art

Polycrystalline silicon or polysilicon for short may be deposited in rod-form from chlorosilanes by means of the Siemens process. The rod shaped polysilicon is then typically crushed into chunks, i.e. chunk polysilicon, ideally in a contamination-free manner. Such a process and a corresponding crusher are described in EP 1 645 333 A1. Chunk polysilicon is a sharp-edged, non-free-flowing bulk material.

U.S. Pat. No. 7,013,620 B2 discloses an apparatus for fully automatic transporting, weighing, portioning, filling and packaging of a high-purity chunk polysilicon. The apparatus comprises a conveying channel for the chunk polysilicon, a weighing apparatus for the chunk polysilicon connected to a funnel, deflection plates made of silicon, a filling apparatus which forms a plastic bag from a high-purity plastic film (made of PE for example) and a welding apparatus for the plastic bag filled with chunk polysilicon. Sheathing components of the apparatus with silicon or with a highly wear-resistant plastic is said to permit low-contamination packaging of the chunk polysilicon.

US 2010/0154357 A1 also describes a method for packaging polycrystalline silicon comprising introducing polycrystalline silicon into a freely suspended, preformed bag, by means of a filling device and subsequently closing the filled bag, wherein the bag is made of high-purity plastic having a wall thickness of from 10 to 1000 μm. Preferably, the closed plastic bag filled with polycrystalline silicon is introduced into a further plastic bag made of PE having a wall thickness of from 10 to 1000 μm and this second plastic bag is closed. This affords a PE double bag.

US 2013/269295 A1 discloses polycrystalline silicon in the form of one or more chunks or one or more round rods, surrounded by at least one film of a thickness of 10 to 1000 μm which encloses the polycrystalline silicon, this at least one film being surrounded by a further film having a reinforcing structure or by a shape-forming element.

The film having a reinforcing structure may be an air bubble film for example. The shape-forming element may be made of PU, polyester or expandable polystyrene or of another plastic.

The chunks welded in film are introduced into a transport container or a secondary packaging. The transport container, ideally a large cardboard box, may have separating elements, for example a set of dividers, which protects the packaged chunks from damage.

US 2013/269295 A1 also discloses a method for packaging polycrystalline silicon in the form of chunks or round rods, wherein at least one film in each case is inserted into a cuboidal cardboard box matched to the dimensions of the polycrystalline silicon to be packaged. The polycrystalline silicon is introduced into at least one film, with a thickness of 10 to 1000 μm, and the film is subsequently welded, enclosing the polycrystalline silicon. This at least one film is surrounded by a further film having a reinforcing structure or by a shape-forming element. Cuboidal cardboard boxes are employed instead of separating elements. These cardboard boxes are preferably matched to the size of the packaging bags or to the amount and dimensions of the polycrystalline silicon to be packaged.

A disadvantage of the foregoing process is that, to protect a first film, a further film having a reinforcing structure or a shape-forming element is required. Moreover, the large packaging needs to contain separating elements or cuboidal cardboard boxes. This makes this type of packaging complex.

WO 2015/007490 A1 discloses a transport container containing at least two plastic bags each containing polycrystalline silicon chunks, characterized by a packing density of greater than or equal to 500 kg/m$^3$ or greater than 800 kg/m$^3$.

The packing density is defined as the starting weight of polycrystalline silicon chunks in relation to the internal volume of the transport container. The more space a packaged polysilicon bag has in a secondary packaging unit, for example a cardboard box, the more damaging the effect of vibrations during transport. Excessively tight packaging leads to an increased incidence of puncturing; excessively loose packaging can likewise lead to punctures and to considerably more fines.

Dividers between the bags such as inner boxes, cell dividers or dividers made of cardboard as described in US 2013/269295 A1 are not absolutely necessary. However, the residual volume present in the transport container (=box volume−volume of all the bags) is filled by specific inserts, for example foam, box inserts, to an extent of greater than 70%, more preferably to an extent of 100%. Preferably, shape-forming elements made of PU, polyester or expandable polystyrene or another polymer are additionally introduced as is also described in US 2013/269295 A1.

The type of packaging described in WO 2015/007490 A1 is also complex. Furthermore, WO 2015/007490 A1 is not suitable for packaging rod pieces.

Thus in the prior art, packaging of polysilicon employs plastic bags which are then assembled into larger packaging units. The complexity and cost of producing these packagings is high. Smaller individual units are disadvantageous because they offer only limited room, if any, for larger chunks and rods.

SUMMARY OF THE INVENTION

The object to be achieved by the invention arose from the problems described previously. This and other objects of the invention are achieved by a container for packaging polysilicon made of corrugated fiberboard and having an n-gonal cross section, wherein n=8-16, comprising a bottom, n=8-16 side walls and a removable lid for closing the container, wherein a double bag made of plastic has been installed in the container, wherein polysilicon has been filled into the double bag. The objects are also achieved by a method for packaging polysilicon which comprises providing polysilicon made of comminuted polysilicon rods produced by deposition of polysilicon in rod-form in a reactor, packaging the polysilicon in a container made of corrugated fiberboard and having an n-gonal cross section, wherein n=8-16, wherein the container comprises a bottom, n=8-16 side walls and a removable lid for closing the container, wherein a double bag made of plastic has been installed in the container, wherein the polysilicon is filled into the double bag and the container is closed with the lid.

The term "double bag" is to be understood as meaning that two bags made of plastic, preferably made of PE, have been installed in the container, wherein one bag has been placed in the other bag (inner and outer bag). This may likewise be a prefabricated bag fabricated from two plastic films (double-walled bag).

The polysilicon to be packaged derives from comminuted polysilicon rods and preferably comprises chunks of different sizes.

In addition, the polysilicon preferably comprises cylindrical or semicylindrical rod pieces.

The packing density, i.e. the weight of the weighed-in polysilicon per unit inner volume of the container, is preferably 900-1300 kg/m$^3$ and more preferably 1000-1100 kg/m$^3$.

The cross section of the container may, for example, be up to the area of a pallet on which the container will be shipped. In one embodiment the cross section of the container has been adapted to the size of standard chemical pallets. For example, standard (chemical) CP5 pallets having a cross section of 760×1140 mm may be used.

In one embodiment the container is employed for large chunks or whole rod pieces of up to 300 mm in diameter and up to 1.2 m in length. In one embodiment both chunks and rod pieces of different sizes are packaged in the container. This makes it possible to further increase the packing density.

The following relates to a container having an n-gonal cross section where n=8. The features and embodiments thus described may be correspondingly applied to containers having an n-gonal cross section where n>8.

In one embodiment the container comprises an octagonal bottom, eight side walls (of identical height) and an octagonal removable lid. In one embodiment the bottom and the lid have a slightly greater cross section so as to secure the side walls.

Figure 1:
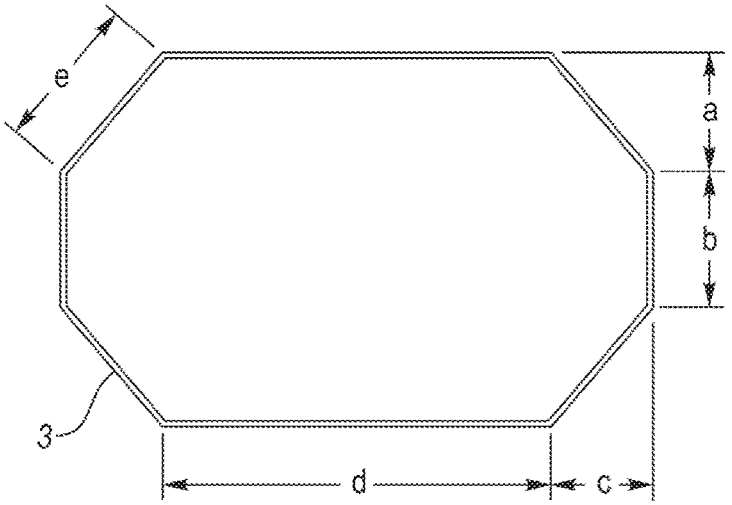
FIG. 1 shows the octagonal cross section of a container.

Respective pairs of the eight side walls are parallel to one another and have the same dimensions, cf. also FIG. 1. The cross section/the bottom surface has the shape of a convex octagon.

A container height of from 400 to 600 mm has proven particularly ergonomic. This allows the bottom of the container to be reached during manual loading and unloading without the operator having to bend over completely.

The combination of the octagonal cross section of the bottom and the side walls with the octagonal lid ensures a particularly low level of bulging or buckling and a high compressive strength.

It is preferable when the packaged polysilicon comprises chunks and cylindrical and semicylindrical rod pieces. In one embodiment chunks and cylindrical or semicylindrical rod pieces are packaged such that the round sides of semicylindrical rod pieces or the cylindrical rod pieces (rod rounds) are disposed at the inner surface of the container. There is no polysilicon, and no chunks, between the rod pieces disposed at the inner surface of the container and the inner surface/inner wall as packaged. The rod pieces may contact the inner wall of the container with their round side. Polysilicon in the form of chunks or rod pieces or both may have been arranged between the rod pieces disposed at the inner walls of the container.

This embodiment provides the greatest possible puncture resistance while simultaneously avoiding relative movements of the chunks.

Sharp-edged chunks are efficaciously prevented from even coming into contact with the bag film and/or the container inner wall. Puncturing of the film and/or the container inner wall would present a risk of contamination by foreign particles and adhering dust.

The semicylindrical and cylindrical rod pieces surrounding the chunks also ensure firm securing of the inwardly disposed chunks so that the relative movements between chunks is contained, thus countering the formation of fines through impact comminution.

In one embodiment, a double plastic bag having a film thickness of from 100 to 200 μm in each case is installed in the container. It has been found that this represents an optimized solution in terms of puncture resistance and handleability taking account of packaging costs. It has been found that thicker films are less easily handleable/not handable in bulk containers and moreover do not fit the contours of the chunks so well, thereby increasing the puncture risk. Thinner films may tear too quickly.

In one embodiment the opening of one of the two bags installed in the container ends at the height of the end of the side walls of the container while the second bag is of a length such that hermetic closing (welding, rolling/gathering together) of this second bag is possible.

It will be appreciated that in another embodiment both bags may protrude above the height of the end of the side walls and be of identical or different lengths and both may be hermetically closed. The shorter of the two bags is not closed which results in less complexity.

In one embodiment a bag is closed by rolling up the bag opening and securing it, for example with an adhesive tape.

A bag closed in this way may be opened by the customer without tools and without risk of contamination of the polysilicon. In a further embodiment the bag is welded.

The features cited in connection with the abovedescribed embodiments of the method according to the invention may be correspondingly applied to the apparatus according to the invention. Conversely, the features cited in connection with the abovedescribed embodiments of the apparatus according to the invention may be correspondingly applied to the method according to the invention. These and other features of the embodiments according to the invention are elucidated in the description of the figures and in the claims. The individual features may be realized either separately or in combination as embodiments of the invention. These features may further describe advantageous implementations eligible for protection in their own right.

LIST OF REFERENCE NUMERALS EMPLOYED

1 chunk
2 rod round
3 container
4 semicylindrical rod piece
5. removable lid
6. inner plastic bag
7. outer plastic bag
8. rolled up closure
9. securing tape The embodiments of the invention which follow refer to the dimensions a, b, c, d and e depicted in FIG. 1. The container comprises two parallel side walls of length b, two parallel side walls of length d and four diagonal side walls of length e. The length e may be calculated from the dimensions a and c.

An overview of the dimensions of the cross sections of four exemplary embodiments of the invention is shown in Table 1.

The ratios of the dimensions of the side walls to one another follow therefrom.

In the embodiment according to example 1 the container comprises two long side walls of dimension d which is twice as long as the side walls of dimension b perpendicular to these side walls.

Thus, $d=2*b$.

TABLE 1

| | a | b | c | d | e |
|---|---|---|---|---|---|
| example 1 | 0.5 | 1 | 0.5 | 2 | 0.71 |
| example 2 | 0.5 | 1 | 0.75 | 1.5 | 0.90 |
| example 3 | 0.25 | 1.5 | 0.25 | 2.5 | 0.35 |
| example 4 | 0.75 | 0.5 | 0.75 | 1.5 | 1.06 |

The four diagonal side walls of dimension e which connect the abovementioned side walls are shorter than the dimension b.

Thus, $e=0.71*b$.

The side length ratios for examples 2-4 are derivable from table 1 in similar fashion. The length d may be up to three times the length b.

The containers generally have two sides with d=1.5–2.5, two sides with b=0.5–1.5 and four sides with e=0.35–1.06.

The containers have ideally been adapted to the sizes of standard chemical pallets.

The aspect ratio I1/I2 of a pallet may be expressed as:

$$I1/I2=(2a+b)/(2c+d)$$

Each of examples 1-4 gives rise to an aspect ratio I1/I2=2/3. This corresponds to the aspect ratio of a CP5 pallet.

It will be appreciated that square pallets such as the CP3 chemical pallet (cross section 1140×1140 mm) may also be employed. In this case the aspect ratio is I1/I2=1. The side lengths reported in table 1 then require corresponding adaptation: for example dimension d may be reduced by 1 in each case.

Figure 2:
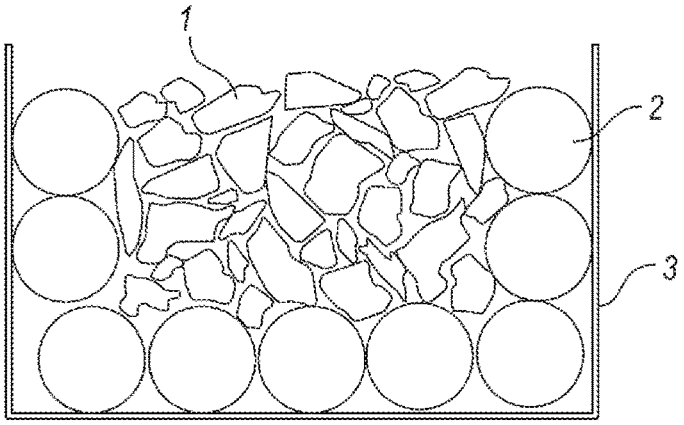
FIG. 2 is a schematic diagram of a container with polysilicon comprising rod rounds (cylinders) arranged therein.

FIG. 2 shows an embodiment where both chunks 1 and rod rounds 2 have been arranged in the container 3.

The rod rounds 2 have been arranged at the bottom and at the side walls of the container 3.

The chunks 1 do not come into contact with the bottom and the side walls of the container 3.

Figure 3:
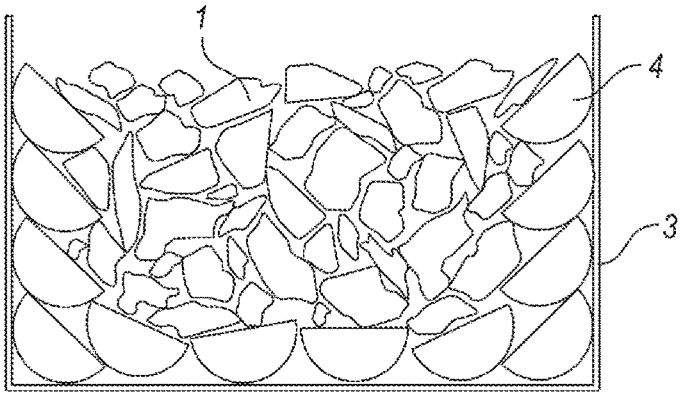
FIG. 3 is a schematic diagram of a container with polysilicon comprising semicylindrical rod pieces arranged therein.

FIG. 3 shows an embodiment where both chunks 1 and semicylindrical rod pieces 4 have been arranged in the container 3.

The semicylindrical rod pieces 4 have been arranged at the bottom and at the side walls of the container 3.

The chunks 1 do not come into contact with the bottom and the side walls of the container 3.

Figure 4:
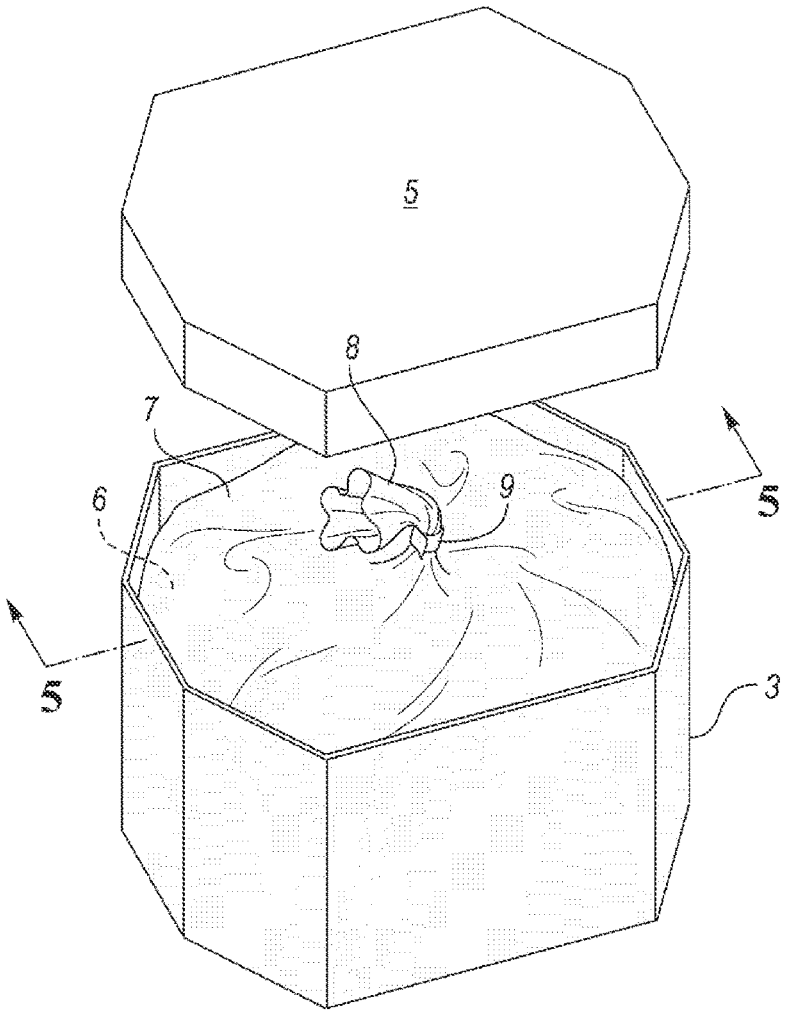
FIG. 4 illustrates an n-gonal container where n=8, the removable container lid, and rolled up and secured outer plastic bag.
Figure 5:
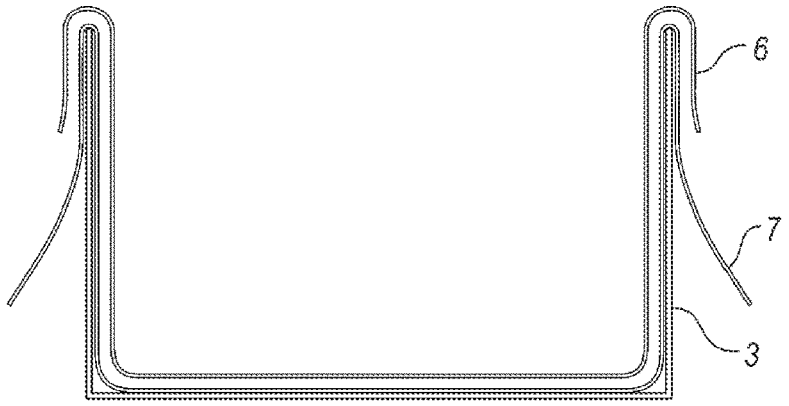
FIG. 5 is a cross-section of a container showing double plastic bags, one being longer than the other.

FIG. 4 shows an n-gonal container 3 where n=8, a removable lid 5 for closing the container, and inner bag 6 within outer bag 7. The outer bag 7 is rolled and secured by adhesive tape 9. FIG. 5 illustrates the container across section 5-5 prior to filling with polysilicon and closing, where two bags 6 and 7, which may have been separately introduced into the container or introduced as a prefabricated double bag, are within the container, the outer bag 7 being longer than the inner bag 6.

The description hereinabove of illustrative embodiments is to be understood as being exemplary. The disclosure made thereby enables a person skilled in the art to understand the present invention and the advantages associated therewith and also encompasses alterations and modifications to the described structures and methods obvious to a person skilled in the art. All such alterations and modifications and also equivalents shall therefore be covered by the scope of protection of the claims.

The invention claimed is:

1. A polysilicon containing package, comprising a corrugated fiberboard container having an n-gonal cross section, wherein n=8 to 16, comprising a bottom, n=8 to 16 side walls, and a removable lid for closing the container, a double bag of plastic installed in the container having an interior comprising polysilicon, wherein polysilicon is positioned within the double bag of plastic in such a way that cylindrical and/or semicylindrical rod pieces made of polysilicon are arranged within the double bag adjacent the bottom and inner walls of the container, and the rod pieces so arranged surround polysilicon in the form of chunks.

2. The container of claim 1, wherein a packing density of polysilicon in the container is 900-1100 kg/m$^3$.

3. The container of claim 1, wherein the double bag is made of plastic films, each having a thickness of 100 to 200 μm.

4. The container of claim 2, wherein the double bag is made of plastic films, each having a thickness of 100 to 200 μm.

5. The container of claim 1, wherein the double bag comprises two plastic bags of different lengths, wherein excess film of a longer plastic bag is rolled up and secured to close the plastic bag.

6. The container of claim 2, wherein the double bag comprises two plastic bags of different lengths, wherein excess film of a longer plastic bag is rolled up and secured to close the plastic bag.

7. The container of claim 3, wherein the double bag comprises two plastic bags of different lengths, wherein excess film of a longer plastic bag is rolled up and secured to close the plastic bag.

8. The container of claim 4, wherein the double bag comprises two plastic bags of different lengths, wherein excess film of a longer plastic bag is rolled up and secured to close the plastic bag.

9. A method for packaging polysilicon to produce a polysilicon-containing package of claim 1, comprising:

providing polysilicon in the form of chunks and in the form of cylindrical and/or semicylindrical rod pieces, providing said container of corrugated fiberboard having an n-gonal cross section, wherein n=8 to 16, said container comprising a bottom, n=8 to 16 side walls and said removable lid for closing said container, said packaging comprising installing said double bag of plastic in said container, followed by filling the polysilicon into said double bag in such a way that said cylindrical and/or semicylindrical rod pieces made of polysilicon are arranged at said bottom and at said inner walls of the container, wherein said rod pieces surround said polysilicon in the form of chunks.

10. The method of claim 9, wherein a packing density of polysilicon in the container is 1000-1100 $kg/m^3$.

11. The method of claim 9, wherein the double bag is made of plastic films each having a thickness of 100 to 200 μm.

12. The method of claim 10, wherein the double bag is made of plastic films each having a thickness of 100 to 200 μm.

13. The method of claim 9, wherein the double bag comprises two plastic bags of different lengths, wherein excess film of the longer plastic bag of the two plastic bags is rolled up and secured to close the plastic bag.

14. The method of claim 10, wherein the double bag comprises two plastic bags of different lengths, wherein excess film of the longer plastic bag of the two plastic bags is rolled up and secured to close the plastic bag.

15. The method of claim 11, wherein the double bag comprises two plastic bags of different lengths, wherein excess film of the longer plastic bag of the two plastic bags is rolled up and secured to close the plastic bag.

16. The method of claim 12, wherein the double bag comprises two plastic bags of different lengths, wherein excess film of the longer plastic bag of the two plastic bags is rolled up and secured to close the plastic bag.

* * * * *